US008764173B2

(12) United States Patent
Haines et al.

(10) Patent No.: US 8,764,173 B2
(45) Date of Patent: Jul. 1, 2014

(54) COMBINATION INK STATUS AND KEY ARRANGEMENT FOR INK SUPPLY

(75) Inventors: Paul Mark Haines, Corvallis, OR (US); Ronald J. Ender, Corvallis, OR (US); Craig L. Malik, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 194 days.

(21) Appl. No.: 13/259,507

(22) PCT Filed: Sep. 15, 2009

(86) PCT No.: PCT/US2009/056964

§ 371 (c)(1), (2), (4) Date: Sep. 23, 2011

(87) PCT Pub. No.: WO2011/034521

PCT Pub. Date: Mar. 24, 2011

(65) Prior Publication Data

US 2012/0162324 A1 Jun. 28, 2012

(51) Int. Cl.

| | |
|---|---|
| ***B41J 2/175*** | (2006.01) |
| ***B41J 2/16*** | (2006.01) |
| ***B41J 2/17*** | (2006.01) |

(52) U.S. Cl.

USPC ..... 347/86; 347/49; 347/84; 347/85

(58) Field of Classification Search

USPC ..... 347/49, 84, 85, 86

See application file for complete search history.

(56) References Cited

U.S. PATENT DOCUMENTS

| | | | | |
|---|---|---|---|---|
| 6,183,077 | B1 | 2/2001 | Hmelar et al. | |
| 6,305,795 | B2 * | 10/2001 | Childers et al. | 347/86 |
| 6,471,333 | B1 | 10/2002 | Powell et al. | |
| 7,452,061 | B2 * | 11/2008 | Childers et al. | 347/86 |
| 2004/0021751 | A1 | 2/2004 | Steinmetz et al. | |
| 2009/0096836 | A1 | 4/2009 | Haines et al. | |

OTHER PUBLICATIONS

Hewlett-Packard Development Company, L.P., PCT International Preliminary Report on Patentability, Application No. PCT/US2009/056964, Report dated Mar. 29, 2012.

* cited by examiner

*Primary Examiner* — Jannelle M Lebron

(57) ABSTRACT

A removable ink supply comprises an ink container including a coupler configured to removably engage a receiver of an ink supply station of an image forming apparatus. The coupler includes an end portion including an array of key holes with each key hole configured to removably receive a respective one key of an array of at least partially conductive keys of the receiver of the ink supply station. A conductive component of the coupler is positioned within the coupler and spaced apart from the end portion. The conductive component is in axial alignment with at least some of the respective key holes to be positioned for selective, removable contact with at least some of the respective keys of the receiver. An absence or a presence of removable contact between the conductive component and the key indicates an out-of-ink status of the image forming apparatus.

9 Claims, 9 Drawing Sheets

COMBINATION INK STATUS AND KEY ARRANGEMENT FOR INK SUPPLY

BACKGROUND

While older-style printers included cumbersome techniques for replacing ink or toner, newer-style printers typically permit simple replacement of ink or toner cartridges. A typical image forming apparatus is designed to receive a uniquely corresponding ink supply container or reservoir for each different color ink or toner. Accordingly, various attempts have been made at using lockout mechanisms to ensure that each reservoir is installed in the proper receptacle of the image forming apparatus. Unfortunately, conventional lockout mechanisms fail to provide sufficient assurance of proper matching between ink reservoirs and their corresponding receptacles at the image forming apparatus.

BRIEF DESCRIPTION OF THE DRAWINGS

Exemplary non-limiting embodiments of the present general inventive concept are described in the following description, read with reference to the figures attached hereto and do not limit the scope of the claims. In the figures, identical and similar structures, elements or parts thereof that appear in more than one figure are generally labeled with the same or similar references in the figures in which they appear. Dimensions of components and features illustrated in the figures are chosen primarily for convenience and clarity of presentation and are not necessarily to scale. Referring to the attached figures:

DETAILED DESCRIPTION

Figure 1:
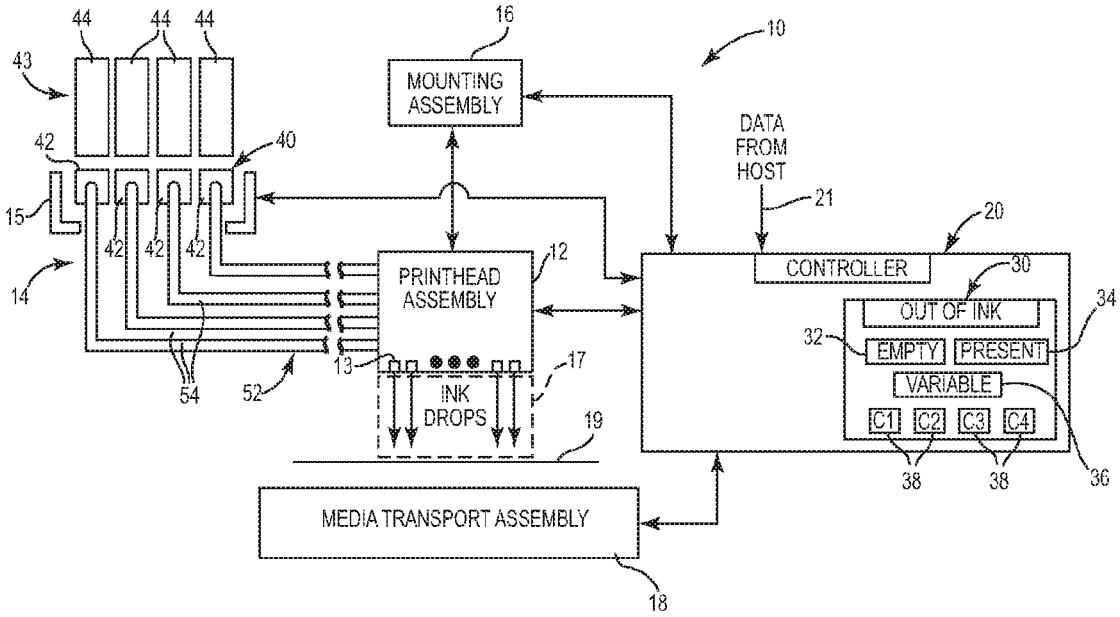
FIG. 1 is a block diagram schematically illustrating an inkjet printing system, according to an embodiment of the present general inventive concept.

In the following detailed description, reference is made to the accompanying drawings which form a part hereof, and in which is shown by way of illustration specific embodiments in which the present general inventive concept may be practiced. In this regard, directional terminology, such as "top," "bottom," "front," "back," "leading," "trailing," etc., is used with reference to the orientation of the Figure(s) being described. Because components of embodiments of the present general inventive concept can be positioned in a number of different orientations, the directional terminology is used for purposes of illustration and is in no way limiting. It is to be understood that other embodiments may be utilized and structural or logical changes may be made without departing from the scope of the present general inventive concept. The following detailed description, therefore, is not to be taken in a limiting sense, and the scope of the present general inventive concept is defined by the appended claims.

Embodiments of the present general inventive concept include a lock-out mechanism, provided via a key/key hole arrangement, and an out-of-ink indicator mechanism, provided via a conductive element. The lock-out mechanism and the out-of-ink indicator mechanism can be implemented together or separately. Accordingly, in some embodiments, the lock-out mechanism is implemented with a key forming part of a receiver of an ink supply station of an image forming apparatus with each key being reciprocally engageable with a key hole on a coupler of an ink cartridge. By providing selective rotational capability of the keys, or by providing an array of receivers and each receiver having a different rotational orientation of its keys, the system provides an effective lock-out mechanism to ensure proper matching of ink containers with ink supply stations.

In some embodiments, a conductive element extends within or is defined by the key to provide a conductive pathway from the receiver of the ink supply station into the ink cartridge. With a conductive tip of the key mated within a corresponding key hole, the conductive tip of the key becomes positioned adjacent a diaphragm portion of a pressure regulator assembly. With this arrangement, the key indicates an out-of-ink status based on a contact (or alternatively, lack of contact) between the conductive tip of the key and the conductive portion of the diaphragm portion.

In some embodiments, the coupler of the ink container cooperates with the keys of the receiver to provide an on/off mechanism to control the flow of ink from the ink container. Upon full engagement of the keys within the coupler, the coupler actuates a valve of the ink container to permit the flow of pressurized ink from the ink container. However, upon complete or partial removal of keys from the coupler, the coupler allows the valve of the ink container to close to stop the flow of ink.

These embodiments, and additional embodiments, are described in more detail in association with FIGS. 1-11.

FIG. 1 illustrates an inkjet printing system 10 in accordance with one embodiment of the present disclosure. Inkjet printing system 10 includes an inkjet printhead assembly 12, an ink supply assembly 14, a carriage assembly 16, a media transport assembly 18, and an electronic controller 20. Inkjet printhead assembly 12 includes one or more printheads which eject drops of ink through orifices or nozzles 13 and toward a print media 19 so as to print onto print media 19. Print media 19 is any type of suitable sheet material, such as paper, card stock, envelopes, labels, transparencies, Mylar, and the like. Typically, nozzles 13 are arranged in one or more columns or arrays such that properly sequenced ejection of ink from nozzles 13 causes characters, symbols, and/or other graphics or images to be printed upon print media 19 as inkjet printhead assembly 12 and print media 19 are moved relative to each other.

Ink supply assembly 14 supplies ink to printhead assembly 12 and includes an array 43 of separate reservoirs 44 or ink containers for storing ink. A receiving station 15 includes an array 40 of receivers 42, with each receiver 42 configured to removably receive a respective one of the reservoirs 44. In a typical arrangement, each reservoir 44 contains a different color of ink. Ink supply assembly 14 also includes an array 52 of supply conduits or hoses 54 that provide a fluid pathway from each respective receiver 42 (and the removably received reservoir 44) to a corresponding printhead of an array of printheads at printhead assembly 12. As such, ink flows from reservoirs 44 to inkjet printhead assembly 12.

In this embodiment, the ink supply assembly 14 is positioned remotely from the printhead assembly 12, with the ink supply assembly 14 communicating ink to the printhead assembly 12 via the array 52 of supply tubes 54. This embodiment is sometimes referred to as an off-axis configuration of the ink supply assembly 14.

However, in other embodiments, ink supply assembly 14 is separate from inkjet printhead assembly 12 but still directly communicates ink to the printhead assembly 12 via a releasable connection, with the ink supply assembly 14 being mounted directly above and at least partially supported by the printhead assembly 12. In this instance, hoses 54 would be omitted from system 10 and receivers 42 would form part of the printhead assembly 12 to enable the reservoirs 44 to be directed received at printhead assembly 12. This embodiment is sometimes referred to as an on-axis configuration of the ink supply assembly 14.

Carriage assembly 16 positions inkjet printhead assembly 12 relative to media transport assembly 18 and media transport assembly 18 positions print media 19 relative to inkjet printhead assembly 12. Thus, a print zone 17 is defined adjacent to nozzles 13 in an area between inkjet printhead assembly 12 and print media 19. In one embodiment, inkjet printhead assembly 12 is a non-scanning type printhead assembly. As such, carriage assembly 16 fixes inkjet printhead assembly 12 at a prescribed position relative to media transport assembly 18. Thus, media transport assembly 18 advances or positions print media 19 relative to inkjet printhead assembly 12.

Electronic controller 20 communicates with inkjet printhead assembly 12, ink supply receiver station 15, media transport assembly 18, and, in one embodiment, carriage assembly 16. Electronic controller 20 receives data 21 from a host system, such as a computer, and includes memory for temporarily storing data 21. Typically, data 21 is sent to inkjet printing system 10 along an electronic, infrared, optical or other information transfer path. Data 21 represents, for example, an image, a document, and/or file to be printed. As such, data 21 forms a print job for inkjet printing system 10 and includes one or more print job commands and/or command parameters.

In one embodiment, electronic controller 20 provides control of inkjet printhead assembly 12 including timing control for ejection of ink drops from nozzles 13. As such, electronic controller 20 operates on data 21 to define a pattern of ejected ink drops which form characters, symbols, and/or other graphics or images on print media 19. Timing control and, therefore, the pattern of ejected ink drops, is determined by the print job commands and/or command parameters. In one embodiment, logic and drive circuitry forming a portion of electronic controller 20 is located on inkjet printhead assembly 12. In another embodiment, logic and drive circuitry is located remotely from inkjet printhead assembly 12.

In one embodiment, controller 20 includes an out-of-ink identification module 30 configured to identify, and communicate to a user, the level of ink in each replaceable reservoir 44. Accordingly, the out-of-ink module 30 includes an empty function 32 configured to signal that the respective reservoir 44 is empty and an ink-present function 34 configured to signal that the respective reservoir contains enough ink to continue operation. The out-of-ink module 30 also includes reservoir or container identifiers 38 (shown as C1, C2, C3, C4) to highlight which reservoir 44 has the indicated status of empty (i.e., out of ink) or that ink is present in the particular reservoir 44.

In some embodiments, the out-of-ink module 30 includes a variable function 36 configured to signal a relative amount or percentage of ink remaining in the respective reservoir 44.

Figure 2B:
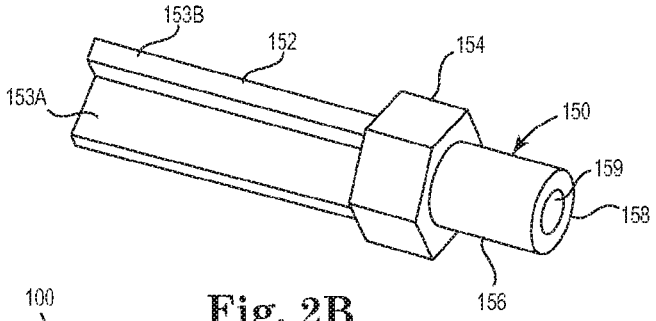
FIG. 2B is a perspective view of a key of the receiver of FIG. 2A, according to an embodiment of the present general inventive concept.
Figure 2A:
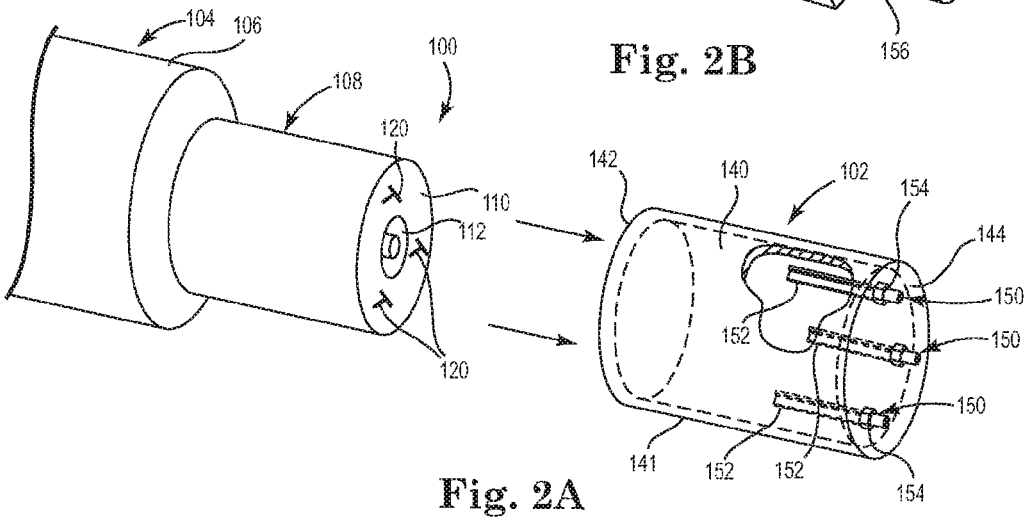
FIG. 2A is a perspective view schematically illustrating a coupler of an ink container engaging a receiver of an ink supply station, according to an embodiment of the present general inventive concept.

FIG. 2A is a perspective view schematically illustrating an assembly 100 that includes a coupler 108 of an ink container 104 aligned to engage a receiver 102 of an ink supply station, according to an embodiment of the present general inventive concept. In one embodiment, ink container 104 and receiver 102 comprise substantially the same features and attributes as reservoir 44 and receiver 42, respectively, as previously described in association with FIG. 1. As shown in FIG. 2A, ink container 104 includes an ink can or reservoir 106 configured to contain a volume of ink (under aerosol pressure) and a coupler 108 at one end of the reservoir 106. The coupler 108 includes an end portion 110 having a central valve or port 112 and having an array of key holes 120 arranged in a spaced apart relationship on end portion 110. In general terms, the coupler 108 defines a size and shape to be removably received within the receiver 102. The coupler 108 also contains a pressure regulating mechanism (not shown) configured to regulate the pressure of the ink as it exits coupler 108 and enters receiver 102. In one aspect, the key holes 120 provide one portion of a lock-out mechanism that cooperates with a reciprocating portion defined by the receiver 102 of the ink supply station.

As further illustrated in FIG. 2A, receiver 102 comprises a generally cylindrical shape defining an open end 142 and a closed end portion 144. In general terms, the receiver 102 defines a size and shape to slidably receive at least coupler 108 of ink container 104. In addition, at closed end portion 144, receiver 102 includes an array of keys 150 arranged in a spaced apart relationship. As illustrated in FIG. 2A, and as further illustrated in FIG. 2B, each key 150 includes a anchor portion 154 and a generally T-shaped blade portion 152 that is sized and shaped to slidably engage key holes 120 of end portion 110 of coupler 108. In addition, key 150 includes an end portion 156 extending from the anchor portion 154 in a direction generally opposite from the blade portion 152.

In some embodiments, the end portion 156 of key 150 defines sleeve 158 or tubular member having a lumen 159 extending therethrough. As later described in more detail in association with FIGS. 7A-7B, the sleeve 158 is sized and shaped to receive a conductive connector to extend through at least part of the sleeve 158.

Referring again to FIG. 2A, the anchor portion 154 of each key 150 is secured within or against the closed end portion 144 of receiver 102 to cause the blade portion 152 of each key 150 to protrude (outwardly and away from closed end portion 144) through an interior of the receiver 102 toward open end portion 142. The keys extend in an orientation generally parallel to a longitudinal axis of the cylindrical shape of the receiver 102. Accordingly, the blade portions 152 of each respective key 150 are spaced apart from each other, and spaced apart from wall 141 of receiver 102 as they project toward open end 142 of receiver 102.

In general terms, coupler 110 is configured with a set of key holes 120 and receiver 104 is configured with a set of keys 150, which together act as a lock-out mechanism. The lock-out mechanism ensures that receiver 104 will be limited to receiving a proper family of ink containers 104 and/or a proper color ink container 104 within the proper receiver 102. Accordingly, in some embodiments, an ink supply station 15 has an array of receivers 42 (FIG. 1) with each receiver 42 having a different rotational configuration of keys 150 such that each receiver 42 is configured to receive a uniquely corresponding coupler 110 (via a reciprocating set of key holes 120).

In some embodiments, in any given ink supply station 15 (FIG. 1), a lock-out mechanism is provided via a variable number of keys, and therefore can include more or less keys 150 (and corresponding key holes 120) than the three keys shown in the illustrated embodiment. In another aspect, while the keys 150 shown in FIG. 2 are shown having a generally uniform spacing from each other (e.g., with three keys, about 120 degrees apart), in other embodiments the keys 150 (and corresponding key holes 120) have non-uniform spacing relative to each other.

Figure 3A:
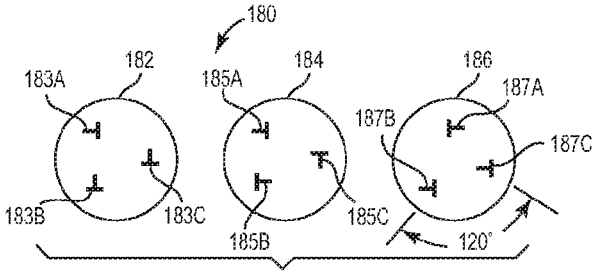
FIG. 3A is a plan view schematically illustrating key hole configurations of an array of ink container couplers, according to an embodiment of the present general inventive concept.
Figure 3B:
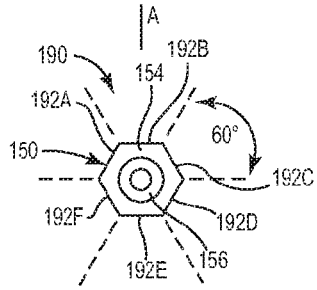
FIG. 3B is a plan view schematically illustrating rotational orientations of a key of a receiver, according to an embodiment of the present general inventive concept.
Figure 4:
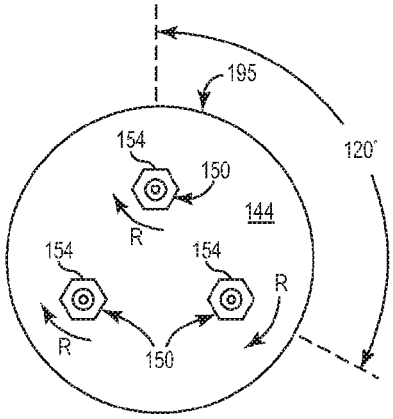
FIG. 4 is a plan view schematically illustrating a rotational orientation of the keys of a receiver of an ink supply station, according to an embodiment of the present general inventive concept.

In another aspect, while the keys 150 shown in FIGS. 3A-4 are shown having a uniform spacing relative to a center of the end portion 144 (and center of end portion 110, respectively), in other embodiments the keys 150 (and corresponding key holes 120) have non-uniform spacing relative to the center of the end portion 144.

In some embodiments, the anchor portion 154 of keys 150 are removably mounted relative to closed end portion 144 of receiver 102 such that each key 150 is fully or partially removable, independent from each other. With this arrangement, any one or more of the keys 150 can be removed and then rotated, thereby causing blade portion 152 to provide a different rotational orientation upon reinstallation of anchor portion 154 relative to the closed end portion 144 of receiver 102, as will be further described in association with FIGS. 3A-4.

In this way, an array of keys 150 on a receiver 102 can be reconfigured from a first configuration that matches a first set of key holes 120 of a coupler 100 into a second configuration that matches a second set of key holes 120 (of a different coupler 110) that have a different rotational orientation than the first set of key holes 120. However, while this feature allows reconfiguring of a lock-out mechanism for an ink supply station, it would be more common that the lock-out mechanism for a given ink supply station is fixed and that the reconfiguration of keys 150 takes place at a manufacturing stage for a given model, style, or family of printers. Nevertheless, upon the offering of differently styled, ink cartridges, the feature of selectively rotatable keys enables a technician or end user the ability to reconfigure the receivers of the ink supply station to receive the different ink cartridges. Alternatively, a new set of receivers that have keys matching the new type of ink cartridge could be provided with the new type of ink cartridge, thereby allowing the technician or user to simply switch out the old receivers and install the new configuration receiver.

In other embodiments, keys 150 are not removable or repositionable relative to closed end portion 144 such that each receiver 102 has a fixed key configuration, i.e., a fixed rotational orientation of the blade portion 152 of each key 150. Accordingly, if a different rotational configuration of keys 150 is desired, a different receiver 102 will be provided with its own fixed configuration of keys 150 having the different rotational orientation of keys 150.

While in one embodiment the blade portion 152 of keys 150 have a generally T-shaped cross-sectional shape, it will be understood that in other embodiments, the blade portion 152 of the keys 150 and the shape of the key holes 120 is not strictly limited to a T-shape, but can include other shapes such as an L-shape or U-shape provided that the shape of the respective keys 150 and key holes 120 remains reciprocal. Moreover, not all of the keys 150 need have the same cross-sectional shape. In particular, to add to a possible number of configurations of keys and key holes for lock-out purposes, some or all of the keys 150 can have different cross-sectional shapes relative to each other, with the corresponding key holes 120 (for each respective key) being shaped to reciprocally mate with their matching key 150.

FIG. 3A is a plan view schematically illustrating an array 180 of different end portions for a coupler of an ink container, according to an embodiment of the present general inventive concept. As illustrated in FIG. 3A, end portion 182 includes a first configuration of T-shaped key holes 183A, 183B, 183C, end portion 184 includes a second configuration of T-shaped key holes 185A, 185B, 185C, and end portion 186 includes a third configuration of T-shaped key holes 187A, 187B, 187C. In addition, in some embodiments, as illustrated in FIG. 3A, for each end portion, at least one key hole has a different rotational orientation relative to the other key holes. For example, for end portion 182, at least one of the key holes (183A) has a different rotational orientation relative to key holes (183B, 183C). In other words, the leg of the T-shape of key hole 183A points in a different direction than the leg of the T-shape of the other key holes 183B, 183C. As illustrated, end portions 184, 186 also have different rotational orientations of among their respective key holes 185A-185C, 187A-187C.

However, in other embodiments, such as the array of key holes 120 illustrated in FIG. 2A, the respective key holes 120 all have the same rotational orientation such that the leg of the T-shape of each key hole 120 all face in the same direction.

FIG. 3B is an end view schematically illustrating a key and various rotational positions of the key, according to an embodiment of the present general inventive concept. As illustrated in FIG. 3B, anchor portion 154 of key 150 comprises a generally hexagon shape with six sides 192A, 192B, 192C, 192D, 192E, 192F. With the T-shaped blade portion 152 having a fixed position relative to the anchor portion 154, rotation of the anchor portion 154 will cause a corresponding rotation in the orientation of the T-shaped blade portion 152. As shown by FIG. 2A, upon securing (removably or permanently) the anchor portion 154 into the end portion 144, the rotational orientation of the T-shaped blade portion 152 of each key 150 becomes fixed.

With the six-sided shape of anchor portion 154 illustrated in FIGS. 3B and 4, the key 150 can be rotated six times, yielding six unique rotational positions or orientations of the T-shape blade portion 150. For example, using a fixed reference line (schematically represented by line A), key 150 can be rotated so that any one of the six sides are in alignment with reference line A, thereby yielding six possible different configurations for a single key. It will be understood that the rotational orientation of any one key 150 is completely independent of the rotational orientation of the other keys 150. With three keys 150, and six possible rotational orientations for each key 150, there are 216 possible unique configurations for the array of the three keys 150. In some other embodiments, a receiver 102 may have a fewer or greater number of keys, resulting in a fewer or greater number of possible key configurations for a given receiver 102.

In addition, in some embodiments, an array of receivers 102 is configured such that the respective receivers among the array each have a different number of keys. For example, in an ink supply station with four receivers (one for cyan, one for magenta, one for yellow, and one for black), one or more receivers 102 of the array have a two-key lock-out mechanism while the remaining receivers of the array have a three-key lock-out mechanism. As in the other embodiments, the keys 150 of each receiver 102 are set to a desired rotational orientation to ensure reciprocal mating of a uniquely corresponding ink container.

In other embodiments, anchor portion 154 comprises other cross-sectional shapes, such a five-sided polygon shape, an eight-sided octagon shape, etc. with each of these different shapes influencing the number of possible combinations or rotational configurations of the respective keys. For example, with three keys and a generally octagonal cross-sectional shape of anchor portion 154, there are 512 possible combinations.

In some embodiments, as previously noted and as illustrated in diagram 195 of FIG. 4, each key 150 is removably mounted relative to the end portion 144 such that each key 150 can be selectively rotated (represented by directional arrow R) to a desired rotational position to effect a desired rotational orientation of the blade portion 152 of each key 150, thereby resulting in the desired configuration of multiple keys 150.

Accordingly, while receivers are reconfigurable in some embodiments as noted above, one embodiment includes a printer have ink supply station with an array of receivers and each receiver having a configuration of fixed keys 150 to receive reciprocating key holes of an array of ink cartridges. Because of the large number of possible configurations, the particular key and key hole arrangement of the lock-out mechanism is highly effective at preventing improper installation of non-matching ink containers.

Figure 5A:
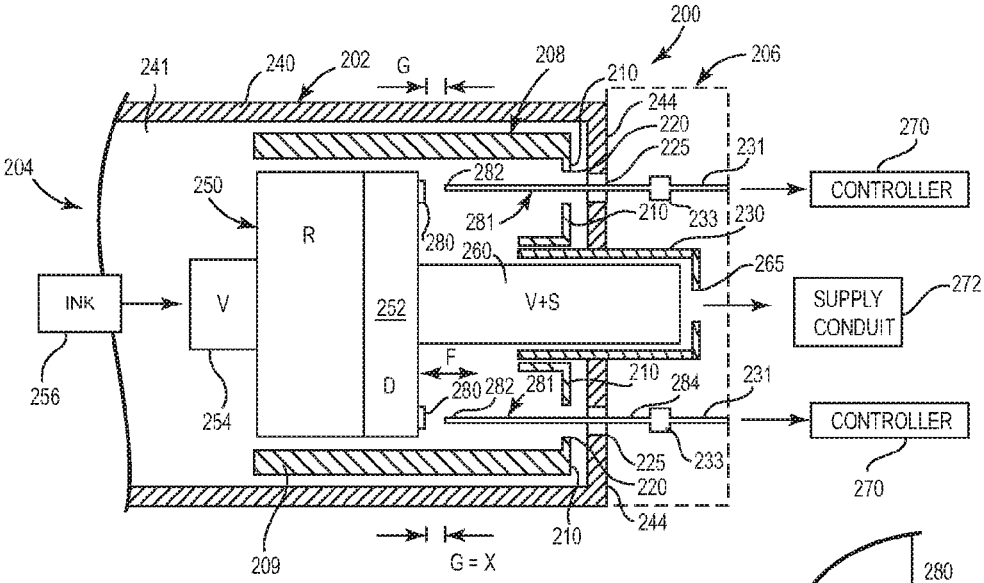
FIG. 5A is a sectional view schematically illustrating engagement of a coupler of an ink container and a receiver of an ink supply station, according to an embodiment of the present general inventive concept.

FIG. 5A is a sectional view schematically illustrating an ink supply assembly 200, according to an embodiment of the present general inventive concept. As illustrated in FIG. 5A, ink supply assembly 200 comprises a receiver 202 of an ink supply station (schematically represented by dashed lines 206) of an image forming apparatus and an ink container 204. In one embodiment, receiver 202 and ink container 204 comprise at least substantially the same features and attributes as receiver 102 and ink container 104, as previously described in association with FIGS. 2A-2B, 3, and 4.

In one embodiment, receiver 202 comprises a generally tubular member including open end 241, wall 240, and closed end portion 244. In general terms, receiver 202 is sized and shaped to slidably receive coupler 208 of ink container 204. In some embodiments, closed end portion 244 includes a central passage portion 230 configured to receive a portion of coupler 208. It will be understood that the central passage portion 230 and coupler 208 may take many forms provided that a fluid-tight seal is established therebetween. In another aspect, closed end portion 244 of receiver 202 includes an array of holes 225, such as holes to permit extension of one or more conductive elements through receiver 202 into and coupler 208 of ink container 104, as will be described in more detail below.

Ink container 204 comprises coupler 208 and ink 256, with coupler 208 including a regulator assembly 250 contained with cap 209. In some embodiments, ink 256 is contained within a bag that is housed within container 204. In general terms, upon engagement with receiver 202, coupler 208 establishes controlled fluid communication of ink 256 with supply conduit 272 of an ink supply station (represented by dashed lines 206). While regulator assembly 250 acts to regulate the pressure of the ink delivered to supply conduit 272. While regulator assembly 250 can take many forms, in one embodiment, regulator assembly 250 includes a diaphragm portion 252, inlet valve mechanism 254, and valve and spring (represented as V+S) mechanism 260. In general terms, cap 209 contains regulator assembly 250 and is structured to maintain diaphragm portion 252 to be spaced apart from end portion 210 of cap 209. In one aspect, the diaphragm portion 252 comprises a variable volume component for containing a variable volume of ink as regulator assembly 250 maintains a desired pressurization on the ink as it flows into the receiver of the ink supply station.

With this in mind, ink supply assembly 200 also includes an out-of-ink identification mechanism comprising at least a conductive element 281 and a conductive component 280. The conductive component 280 is arranged on a surface of diaphragm portion 252 while conductive element 281 extends through an interior of cap 209, through holes 220 of coupler 208, and through holes 225 of closed end portion 244 of receiver 202. In one embodiment, conductive element 281 is secured in place relative to closed end portion 244 of receiver 202 with fastening mechanisms to maintain a fixed position relative to conductive portion 280. In some other embodiments, the conductive element 281 forms part of a key, as later described in more detail in association with FIGS. 6-7B. In these latter embodiments, the structure of key acts to secure the conductive element 281 in place relative to the closed end portion 244 of receiver 202.

In the particular embodiment illustrated by FIG. 5A, the key and key hole arrangement is not necessarily present, such that assembly 200 provides an out-of-ink function without the lock-out function that would be provided via keys and reciprocating key holes. Yet, in other embodiments, similar to the one previously described in relation to FIGS. 2A and 2B, an assembly 100 includes a lock-out function provided via keys and reciprocating key holes, but omits an out-of-ink function because no conductive element is provided within the keys. Finally, in some other embodiments, as described in association with at least FIG. 8A, 8B, an assembly 400 includes a combination of a lock-out function provided via keys and reciprocating key holes (as in FIGS. 2A-2B), and an out-of-ink function, which is provided via the conductive element (like conductive element 281) that forms at least part of each key.

Figure 5B:
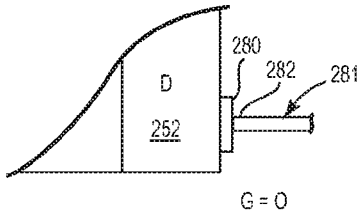
FIG. 5B is an enlarged view schematically illustrating engagement between a conductive element of a receiver and a conductive component of the coupler, according to an embodiment of the present general inventive concept.

With further reference to the embodiment illustrated by FIG. 5A-5B, with conductive element 281 in a fixed position and with diaphragm portion 252 at least partially movable toward and away from first end 282 of conductive element 281 (as represented by arrow F), conductive portion 280 is in selective, removable contact against first end 282 of conductive element 281. In one embodiment, when ink is present in ink container 204, diaphragm portion 252 causes contact between conductive portion 280 and end 282 of conductive element 281, as illustrated in FIG. 5B, such that gap G equals zero. However, when ink container 204 is empty, diaphragm portion 252 moves away from first end 282 of conductive element 281 such that no contact occurs between conductive portion 280 and first end 282 of conductive element 281 such that gap G equals x (x is greater than zero), as shown in FIG. 5A.

As further illustrated in FIG. 5A, conductive element 281 has a length such that a second end 284 of each conductive element 281 is positioned external to the end portion 244 of receiver 202 for electrical communication with controller 270 to provide a signal pathway to controller 270 regarding the out-of-ink status of ink container 204. In some embodiments, second end 284 is electrically connected to a connector wire 231 (via coupler 233), with the connector wire 231 being in electrical communication with controller 270.

Accordingly, some embodiments of the general present inventive concept provide a conductive element of a receiver of an ink supply station that extends toward and into a coupler of an ink container for removable contact with a conductive portion of the coupler. Upon a change in position of the conductive portion, caused by the presence or absence of ink within a diaphragm portion of the coupler, an out-of-ink status is indicated via the contact or lack of contact between the conductive element of the receiver and the conductive portion of the coupler.

Figure 6:
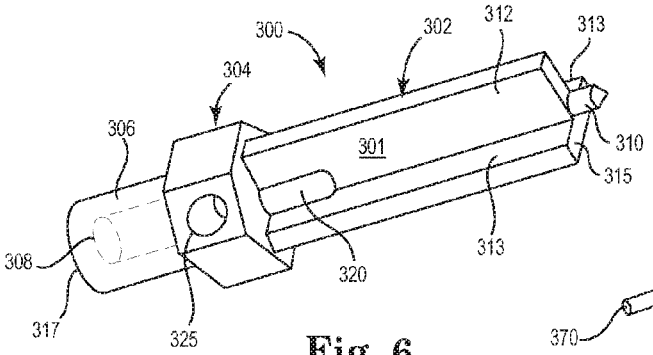
FIG. 6 is a perspective view of a key, according to an embodiment of the present general inventive concept.

FIG. 6 is a perspective view of a key 300, according to an embodiment of the present general inventive concept. In one embodiment, key 300 comprises substantially the same features and attributes as key 150, as previously described in association with FIGS. 2A and 2B, except for additionally including a conductive element at least partially extending therethrough. Accordingly, as illustrated in FIG. 6, key 300 includes a generally T-shaped blade portion 302, anchor portion 304, and sleeve portion 306 in a manner substantially similar to key 150, as previously illustrated in association with FIGS. 2A, 2B. However, as further illustrated in FIG. 6, key 300 includes a conductive tip 310 that protrudes outwardly from a first end 315 of key 300. In one embodiment, the T-shaped blade portion 302 comprises leg portion 302 and transverse portion 313 with the conductive tip 310 positioned at a junction of leg portion 312 and transverse portion 313.

In general terms, key 300 is formed of a conductive material such that substantially the entire key 300 including tip 310 comprises a conductive material. In some embodiments, key 300 comprises a conductive plastic material while in other embodiments, key 300 comprises a machined (or die cast) metallic material, such as brass, aluminum, or zinc.

As further illustrated in FIG. 6, sleeve portion 306 defines a bore (represented by dashed lines 308) that extends toward first end 315, beyond anchor portion 304, to communicate with a pocket 320 sized and shaped to receive a terminal end of a connector wire, similar to connector wire 231 (FIG. 5A).

As illustrated in FIG. 6, in some embodiments, anchor portion 306 also defines an aperture 325 in communication with bore 308, so that a set screw (not shown) may be fastened through aperture 325 to secure a connector within bore 308. In this way, a conductive pathway is established throughout a length of key 300, i.e., from first end 315 of key 300 to second end 317 of key 300.

In addition, in some embodiments, open pocket 320 of key 300 provides an access point to secure the connector to the body 301 of key 300 via soldering the end of the connector against body 301. With the connector so secured, the open pocket 320 allows visible confirmation that a proper connection has been made between the connector and the key 300.

With this in mind, key 300 provides both a lock-out function via the shape and size of the blade portion 302 and anchor portion 304 (as previously described in association with FIGS. 2A, 2B) and an out-of-ink function via the conductive material defining key 300 to provide a conductive pathway from a conductive portion of the ink container to a controller of an ink supply station, in manner similar to that previously described in association with FIGS. 5A-5B.

Figure 7B:
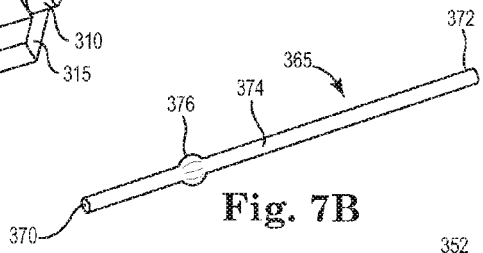
FIG. 7B is a perspective view of a conductive element, according to an embodiment of the present general inventive concept.
Figure 7A:
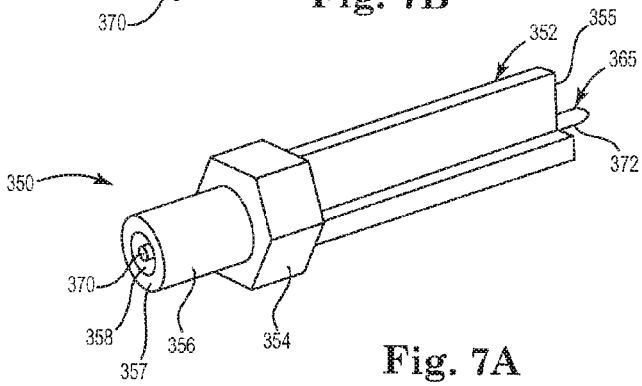
FIG. 7A is a perspective view of a key, according to an embodiment of the present general inventive concept.

FIG. 7A is a perspective view of a key 350, according to an embodiment of the present general inventive concept. In one embodiment, key 350 comprises substantially the same features and attributes as key 150, as previously described in association with FIGS. 2A and 2B, except for additionally including a conductive element extending substantially through an entire length of key 350. In this embodiment, key 350 is formed by molding a non-conductive material (in the shape of the key 350) about an elongate conductive element, such as conductive element 365 illustrated in FIG. 7B. As illustrated in FIG. 7B, conductive element 365 includes first end 372, second end 370, shaft 374, and bulb portion 376. Bulb portion 376 is shaped to facilitate molding of a generally larger diameter anchor portion 354 and to help anchor conductive element 365 within key 350.

Using insert molding techniques familiar to those skilled in the art, the blade portion 352, the anchor portion 354, and the sleeve portion 356 are formed at one time within a mold, with the resulting structure including conductive element 365 extending through the entire length of key 350. In this arrangement, a first end 372 of conductive element 365 protrudes from first end 355 of key 350 and a second end 370 of conductive element 365 protrudes from second end 357 of key 350 (through sleeve portion 356).

With this in mind, key 350 provides both a lock-out function via the shape and size of the blade portion and anchor portion (as previously described in association with FIGS. 2A, 2B) and an out-of-ink function via the conductive material element 365 extends within key 350 to provide a conductive pathway from a conductive portion of the ink container to a controller of an ink supply station, as previously described in association with FIGS. 5A-5B.

Figure 8A:
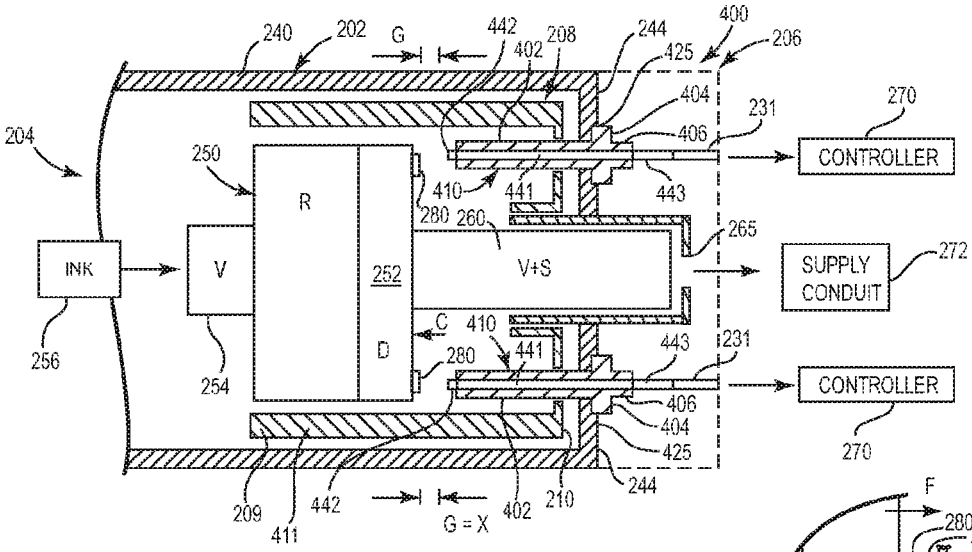
FIG. 8A is a sectional view schematically illustrating engagement of a coupler of an ink container and a receiver of an ink supply station, according to an embodiment of the present general inventive concept.
Figure 8B:
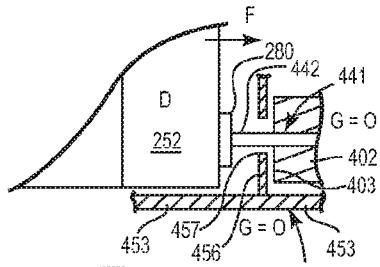
FIG. 8B is an enlarged, partial sectional view schematically illustrating engagement between a conductive element of a key and a conductive component of the coupler, according to an embodiment of the present general inventive concept.

FIGS. 8A and 8B are sectional views of assembly 400, according to an embodiment of the present general inventive concept. In one embodiment, assembly 400 comprises substantially the same features and attributes as assembly 200, as previously described in association with FIGS. 5A, 5B, except for additionally including a key and key hole arrangement through which a conductive element extends. In particular, where assembly 200 included a conductive element 281 that stood alone (i.e. apart from a lock-out key), assembly 400 includes keys 410 with each key 410 including a conductive element in at least one of the forms previously described in association with FIGS. 6-7B.

Accordingly, in one aspect, key 410 includes a blade portion 402, anchor portion 404, and sleeve portion 406, with an exposed conductive tip 442. As further illustrated in FIG. 8A, a connector 231 is secured to a second end 443 of the key 410 and extends from key 410 for electrical coupling to controller 270, to enable identifying an out-of-ink status of ink container 204.

In one aspect, anchor portion 404 of the respective keys 410 is secured (removably or permanently) within holes 425 of closed end portion 244 of receiver 202, with each hole 425 being sized and shaped for reciprocal mating with anchor portion 404. In this arrangement, the position of key 410, and therefore of conductive portion 442, is fixed relative to closed end portion 244 of receiver 202, and fixed relative to the end portion 210 of coupler 208, as will be further described in association with FIG. 8B.

As illustrated in FIG. 8A, with key 410 in a fixed position relative to closed end portion 244, a gap (G equals x, where x>0) extends between conductive portion 280 and conductive tip 442 of key 410. As previously described in relation to FIGS. 5A-5B, the gap G may correspond to an absence of ink or a presence of ink, depending upon the programming of controller 270.

FIG. 8B is an enlarged partial sectional view that schematically illustrates the interaction of the conductive tip 442 of key 410 and the conductive portion 280 of diaphragm portion 252 of coupler 208 of ink cartridge 204. As illustrated by FIG. 8B, coupler 208 also includes a limiting mechanism 451 to secure end 403 of key 410 in a fixed position relative to the movable diaphragm portion 252. In one embodiment, limiting mechanism 451 includes a side wall 453 and a floor portion 456 defining an aperture 457. The side wall 453 is supported by, or forms part of, wall 411 of cap 209. The floor portion 456 extends generally perpendicular to the side wall 453 and is sized to contact and limit movement of first end 403 of key 410. Aperture 457 is positioned to allow conductive tip 442 to protrude through aperture 457 while floor portion 456 generally restrains axial movement of key 410.

As shown in FIG. 8B, in one embodiment, diaphragm portion 252 is an expanded configuration which forces conductive portion 280 into contact against conductive tip 442 of key 410 (represented by directional arrow E), such that the gap (G) equals zero, so that an electrical pathway is established between conductive portion 280 and the at least partially conductive key 410, to thereby establish electrical communication with controller 270.

The directional arrow C in FIG. 8A represents moveable behavior of diaphragm portion 252, wherein when diaphragm portion 252 contracts, conductive portion 280 moves away from conductive tip 442 of key 410.

The embodiment illustrated by FIG. 8A, 8B includes contact between the conductive portion 280 and conductive tip 442 when diaphragm portion 252 is an expanded state 256 (ink present in container 256) and a lack of contact when the diaphragm portion 252 is in a contracted state (ink absent in container).

However, in other embodiments, the opposite configuration is employed in which the conductive portion 280 is configured as part of a lever mechanism that deflects upon a change in the expanded or contracted state of diaphragm portion. In this embodiment, contact exists between the modified conductive portion 282 and the conductive tip 442 when the diaphragm portion 252 is a contracted state (ink not present) and a lack of contact occurs between the modified conductive portion 282 and the conductive tip 442 when the diaphragm portion 252 is an expanded state (ink present).

Accordingly, these embodiments provide a mechanism to indicate to a controller 270 the absence or the presence of ink in container 204 based on a change in contact between the conductive portion 280 and the conductive tip 442.

With this arrangement, as mounted within assembly 400, key 410 simultaneously provides a lock-out mechanism via the shape and size of key 410 (e.g., the blade portion 402 and the anchor portion 404) and an out-of-ink indicator mechanism via the conductive pathway established from ink container to the ink supply station.

Figure 9:
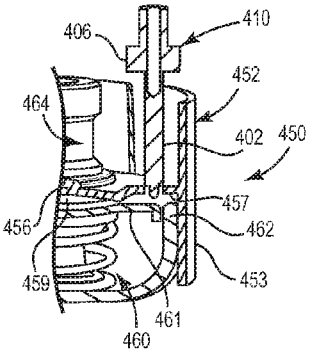
FIG. 9 is a partial sectional view schematically illustrating a coupler of an ink container, according to an embodiment of the present general inventive concept.
Figure 10:
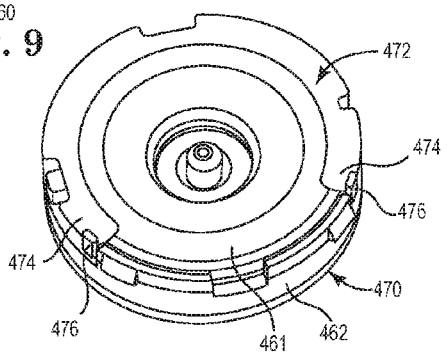
FIG. 10 is a top perspective view of a conductive component of an out-of-ink indicator of a coupler of an ink container, according to an embodiment of the present general inventive concept.
Figure 11:
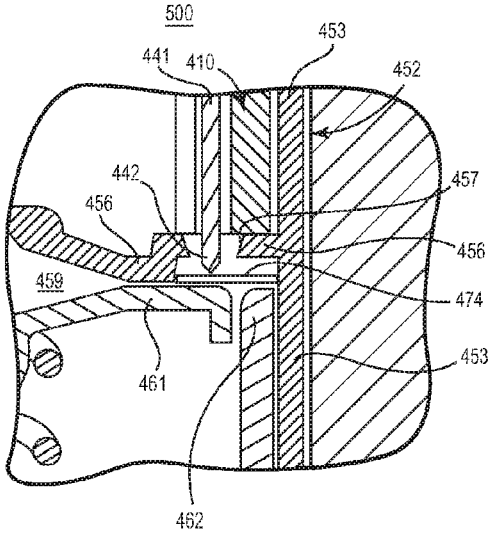
FIG. 11 is a partial sectional view schematically illustrating an out-of-ink indicator mechanism of an ink supply assembly, according to an embodiment of the present general inventive concept.

FIGS. 9-11 further schematically illustrate a coupler of an ink container, according to an embodiment of the present general inventive concept. In particular, FIGS. 9-11 further illustrate an embodiment of a conductive portion of the coupler and keys of a receiver that selectively engage the conductive portion to indicate an out-of-ink status.

FIG. 9 is a partial sectional view of a regulator assembly 450 of a coupler. As illustrated in FIG. 9, assembly 450 comprises a body 452, a valve mechanism 462, and a support structure 460. The body 452 includes a generally cylindrical shape defining a wall 453 and a floor portion 456 that extends across a diameter of body 452. Key 410 extends within a portion of body 452, as illustrated further in FIG. 11. The floor portion 456 includes an aperture 457, substantially similar to the floor portion 456 and aperture 457 illustrated in FIG. 8B. A bottom portion of the support structure 460 generally defines a cup while the upper portion of the support structure 460 defines a top edge of wall 462 that supports a diaphragm cup 461. A diaphragm 459 is enclosed between floor portion 456 and diaphragm cup 461, as is also further schematically illustrated in FIG. 11.

FIG. 10 is a top perspective view schematically illustrating a diaphragm structure 470 and a conductive portion 472 mounted thereon, according to an embodiment of the present general inventive concept. As illustrated in FIG. 10, diaphragm structure 470 includes at least the side wall 462 of support structure 460 and the diaphragm cup 461. While conductive portion 472 can take many forms or shapes, as illustrated in FIG. 10 conductive portion 472 defines a generally C-shaped ring having opposite end portions 474. In addition, conductive portion 472 is generally mounted about an outer edge of diaphragm structure 470, these end portions 474 of conductive portion 474 are supported by posts 476 of side wall 462.

In one embodiment, these conductive portions 474 correspond generally to the conductive portions 280 (previously described in association with FIGS. 5A-5B and 8A-8B) in relation to their function and position.

In one embodiment, as illustrated in FIG. 10, an edge portion of diaphragm cup 461 includes posts 476 which are mechanically coupled to conductive portions 474 such that expansion and contraction of the diaphragm 459 (FIGS. 9, 11) results in axial movement of the diaphragm cup 461 and therefore axial movement of posts 476, thereby causing a deflection of conductive portion 474. In some configurations, this deflection of posts 476 cause conductive portion 474 to move into contact with conductive tip 442 of key 410. In other configurations, this deflection of posts causes conductive portion 474 to move out of contact with conductive tip 442 of key 410.

FIG. 11 is an enlarged, partial sectional view of a regulator assembly, according to an embodiment of the present general inventive concept, further highlighting the relationship between conductive portion 474 of the regulator assembly and the conductive tip 442 of key 410. As illustrated in FIG. 11, floor portion 456 supports end 403 of key 410 while allowing conductive tip 442 to protrude downwardly through aperture 457 for selective contact with conductive portion 474. It will be understood, as previously described, that key 410 and conductive tip 442 remain in a stationary position once key 410 has been inserted into regulator assembly and that the conductive portion 474 is in contact or out of contact with the conductive tip 442 of key 410 to reflect the presence or absence of ink within the ink container connected to the regulator assembly.

Figure 12:
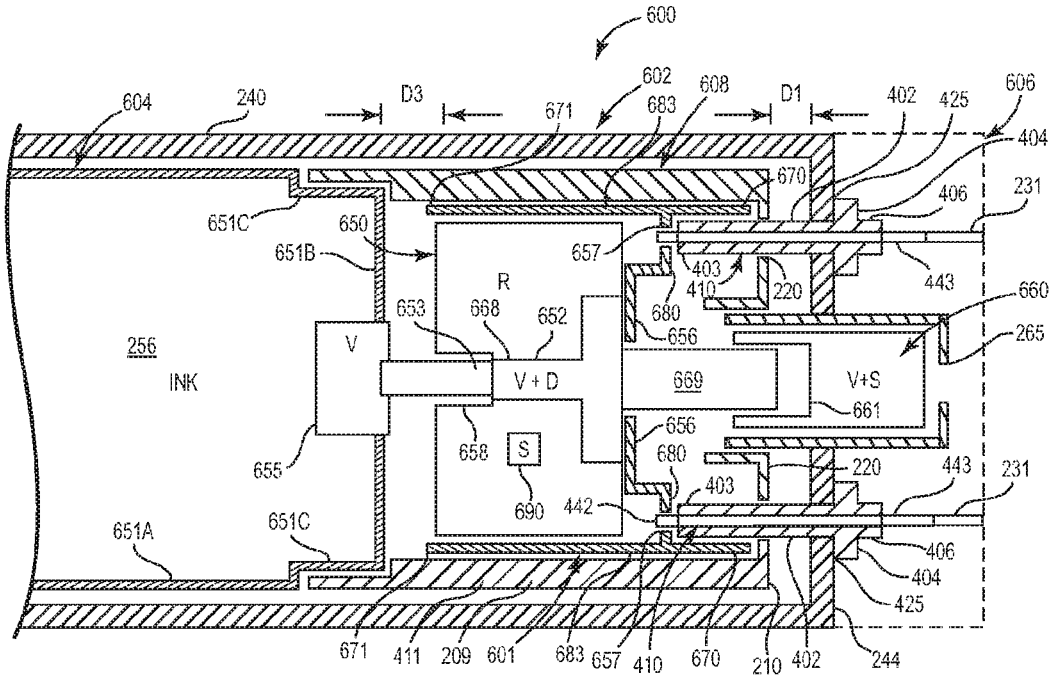
FIG. 12 is a sectional view of an assembly of a coupler of an ink container, according to one embodiment of the present general inventive concept.
Figure 13:
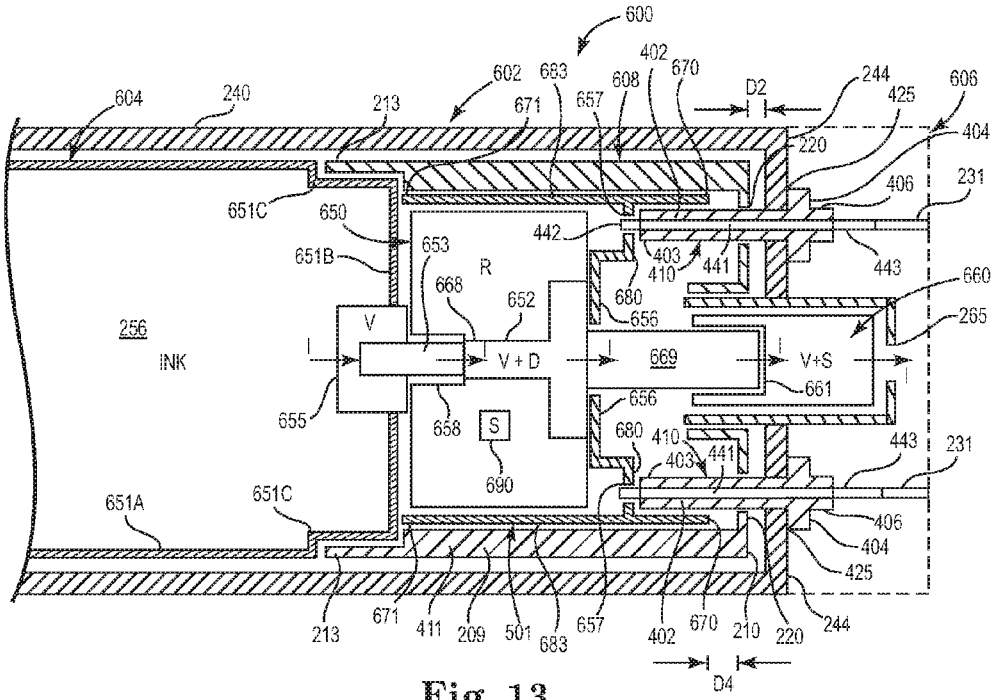
FIG. 13 is a sectional view of a coupler of an ink container, according to one embodiment of the present general inventive concept.

FIG. 12 is a sectional view of an assembly 600 of a coupler 608 of an ink container 604 partially engaged with a receiver 602 of an ink supply station 606, according to one embodiment of the present general inventive concept, prior to actuation of a valve of the ink container. FIG. 13 is a sectional view of a coupler 608 of an ink container 604 fully engaged with a receiver 602 of an ink supply station 606, according to one embodiment of the present general inventive concept, resulting in actuation of the valve of the ink container.

In general terms, FIGS. 12-13 illustrate an embodiment in which engagement of keys 410 of receiver 602 with coupler 608 provides an "on/off" function for controlling the flow of pressurized ink from a valve 655 of ink container 604. Prior to full engagement of keys 410 of receiver 602 within coupler 608, the valve 655 of ink container 604 remains sealed and no ink flows. Upon full engagement of keys 410 of receiver 602 within coupler 608, the valve 655 of ink container 604 is opened to permit the flow of pressurized ink from ink container 604. It will be understood that in some embodiments, the on/off mechanism is implemented separate from or without an out-of-ink indicator mechanism (as previously described in association with FIGS. 5A-5B and 8A-8B) or while in other embodiments, the on/off mechanism is implemented in combination with the out-of-ink indicator mechanism.

In one embodiment, as illustrated in FIGS. 12-13, assembly 600 comprises substantially the same features and attributes as assembly 200 and 400, as previously described in association with FIGS. 5A-5B and 8A-8B, respectively, except for coupler 608 of assembly 600 including at least a more detailed regulator 650 and the inclusion of a frame 601 configured to facilitate actuation of valve 655 of ink container 604.

As illustrated in FIG. 12, coupler 608 includes a frame 601 that contains a side wall portion 683 and a transverse wall portion 656 that generally contains regulator 650. In one aspect, transverse wall portion 656 includes contact portions 680 that define apertures 657, with each aperture 657 permitting protrusion of a conductive tip 442 of keys 410, as in the prior embodiment of FIGS. 8A-8B. In another aspect, the contact portions 680 of transverse wall portion 656 are positioned to engage an end 403 of a respective key 410. Side wall portion 683 of frame 601 includes a first end 670 and a second end 271 opposite the first end 670.

As illustrated in FIG. 12, coupler 608 is slidably inserted into receiver 602 such that keys 410 slidably engage holes 220 of coupler 608 and keys 410 are advanced therethrough until end 403 of keys 410 makes contact with contact portion 680 of transverse wall portion 656. In this position, first end 670 of side wall portion 683 of frame 601 is in a close proximity to end portion 210 of coupler 608 and second end 671 of side wall 683 of frame 601 of coupler 608 is spaced apart from (represented by distance D3) end wall portion 651B of ink container 604, such that regulator 650 does not engage valve 655 of ink container 604 and stem portion 659 of regulator 650 does not fully engage a valve and spring portion 660 of receiver 602. Moreover, the partial engagement of coupler 608 relative to receiver 602 is further illustrated by a distance D1 between end portion 210 of coupler 608 and closed end portion 244 of receiver 602.

As illustrated in FIG. 12, ink container 604 includes a side wall 651A, end wall 651B, and necked portion 651C. Valve 655 of container 604 is located at end wall 651B and includes a stem portion 653 that protrudes generally outwardly away from a body of valve and from end wall 651B. Stem portion 653 defines a generally hollow member and is movable relative a body of valve 655 such that pressing the stem portion 653 inward relative to container 604 causes valve 655 to open and release pressurized ink through stem portion 653, as will be further described in association with FIG. 13. Regulator 650 includes a recess portion 658 sized and shaped to receive the stem portion 653 of valve 655 of ink container 604.

Regulator 650 also includes a valve and diaphragm assembly 652 having a first end 668 and a second end 669. The first end 668 is located at recess 658 while the second end 669 defines a stem portion configured to slidably engage a recess 661 of a valve and spring assembly 660 of receiver 602. However, as illustrated in FIG. 12, with coupler 608 in partial engagement with receiver 602, a gap remains between stem portion 669 of the valve and diaphragm assembly 652 of coupler 608 and a recess 661 of the valve and spring assembly 660 of receiver 202.

As illustrated in FIG. 13, upon further sliding engagement of coupler 608 with receiver 602, end 403 of keys 410 forces frame 601 to move axially relative to side wall 411 of cap 209. This axial movement of frame 601 in turn, causes further sliding movement of regulator 650 until regulator 650 fully engages valve 655 of ink container 604, as described in more detail below. With this in mind, in some embodiments, regulator 650 includes a spring component 690 positioned and configured to bias the regulator 650 and frame 601 toward the position shown in FIG. 12. However, upon application of a sufficient axial force applied via keys 410 engaging contact portion 680 of frame 601, spring component 690 is compressed sufficiently to allow axial movement of frame 601 until valve and diaphragm assembly 652 of regulator 650 forces stem portion 653 to slide inward relative to the body of valve 655, as illustrated in FIG. 13, to cause valve 655 of ink container 604 to open within container 604, thereby allowing the flow of pressurized ink from container 204, through valve 255 (represented by arrow I), through stem portion 653, through valve and diaphragm assembly 652, and so on, until ink passes into supply conduit 272. In the fully engaged position illustrated in FIG. 13 in which valve 655 of ink container 604 is open and engages, via stem portion 653, valve and diaphragm assembly 652 of regulator 650, the previous gap (as represented by distance D1 in FIG. 12) between end portion 210 of coupler 608 and closed end portion 244 of receiver 602 is substantially reduced to a minimal amount (as represented by distance D2 in FIG. 13) and the previous gap (as represented by distance D3 in FIG. 12) between end portion 671 of frame 601 and end wall 651B of ink container 604 is substantially reduced to a negligible amount.

In addition, FIG. 13 illustrates the extent of axial movement of frame 601 within cap 209 of coupler 608 via a gap (as represented by distance D4) between first end 670 of frame 601 and end portion 210 of cap 209 of coupler 608. In comparison, in FIG. 12 little or no gap exists between the first end 670 of frame 601 and the end portion 210 of cap 209 of coupler 608.

Although not explicitly shown, it will be understood that receiver 602 and/or coupler 608 include additional releasable locking structures to maintain the fully engaged state until a later time, at which the coupler 608 is selectively released relative to the receiver 202 to allow removal of ink container 604 from receiver 202.

Accordingly, as illustrated in FIGS. 12-13, engagement of keys 410 of receiver 602 with frame 601 of coupler 608 provides an "on/off" function for valve 655 of ink container 604. With keys 410 of receiver 602 fully engaged within coupler 608, frame 601 forces full engagement of valve and diaphragm assembly 652 relative to valve 655 of ink container 604 to open valve 655 via stem portion 653, thereby permitting the free flow of pressurized ink from container 604 into regulator 650 for passage into supply conduit 272 (via valve and spring assembly 660 of receiver 602). Conversely, by disengaging keys 410 of receiver 602 from frame 601 of coupler 608, the valve and diaphragm assembly 652 of regulator 650 axially moves away from container 604 and releases the pressing force on stem portion 653 to close valve 655 of ink container 604, thereby stopping the flow of pressurized ink from container 604 and effectively re-sealing ink container 604.

In another embodiment, keys 410 are mounted on a movable platen cooperable with the closed end portion 244 of receiver 602 and with end portion 210 of coupler 608 such that the on/off function is provided as an on-demand capability. Movement of the platen is governed by controller 270. In particular, selective movement of the platen toward and away from the coupler 608 moves keys 410 into and out of engagement, respectively, with the frame 601 of the coupler 608 to open and close, respectively, the valve 655 of ink container 604.

Embodiments of the present general inventive concept include a lock-out mechanism, provided via a key/key hole arrangement, and an out-of-ink indicator mechanism, provided via a conductive element. The lock-out mechanism and the out-of-ink indicator mechanism can be implemented together or separately. When provided as a combination, the assembly provides a robust, efficient manner of establishing fluid communication between an ink container and a receiver of an ink supply station. In addition, in some embodiments, in addition to the out-of-ink indicator mechanism and the lock-out mechanism, the key/key hole arrangement also provides an on/off mechanism to further control the flow of ink from the ink container.

Although specific embodiments have been illustrated and described herein, it will be appreciated by those of ordinary skill in the art that a variety of alternate and/or equivalent implementations may be substituted for the specific embodiments shown and described without departing from the scope of the present general inventive concept. This application is intended to cover any adaptations or variations of the specific embodiments discussed herein. Therefore, it is intended that this present general inventive concept be limited only by the claims and the equivalents thereof.

What is claimed is:

1. An ink supply coupling assembly comprising:

an ink container including a coupler, the coupler including:

an end portion including a key hole;

a conductive component contained within the coupler and spaced apart from the end portion, the conductive component in alignment with the key hole;

a receiver station configured to removably, securably receive the coupler of the ink container to establish selective fluid communication between the ink container and the receiver station, the receiver station including a key projecting outward and configured to reciprocally engage, and extend through, the key hole of the coupler of the ink container; and a first conductive element including a first end, a second end, and defining at least a portion of the key to provide an electrical communication pathway from an interior portion of the coupler of the ink container into the receiver station, wherein the first end is positioned to be in selective removable contact with the conductive component of the ink container to indicate one of a presence or an absence of ink within the ink container; and wherein the key hole comprises a plurality of key holes arranged in a spaced apart relationship on the end portion of the coupler, wherein the key comprises a plurality of keys arranged in a spaced apart relationship on the interior portion of the receiver station, wherein the respective key holes are arranged with a size, shape, and position to reciprocally mate with the respective keys.

2. The ink supply coupling assembly of claim 1, wherein the respective keys and the respective reciprocating key holes comprise at least one of a cross-sectional T-shape or a cross-sectional U-shape.

3. The ink supply coupling assembly of claim 1, wherein the keys of the receiver station are arranged with a uniform spacing between the respective keys and the key holes of the coupler are arranged with a uniform spacing between the respective key holes.

4. The ink supply coupling assembly of claim 1, comprising:

an array of receivers, including the first receiver station;

an array of ink container, including the first ink container;

wherein each receiver includes respective keys arranged in a unique configuration different than the array of keys of the other respective receivers of the array and each ink container includes an array of key holes configured to reciprocally mate uniquely with a respective one of the array of keys of the respective receivers.

5. The ink supply coupling assembly of claim 1, wherein each key includes a blade portion with a first cross-sectional shape and wherein at least one key of the array has a first rotational orientation of the blade portion that is different than a second rotational orientation of the blade portion of the other respective keys of the array.

6. The ink supply coupling assembly of claim 1, and further comprising a printer including:

a printhead assembly in fluid communication, via the receiver station of the ink supply station, with the ink container.

7. The ink supply coupling assembly of claim 1, comprising at least one of:

the key including the first conductive element and being defined substantially entirely by a conductive material; or the key including a body defining a non-conductive material and the first conductive element extending through substantially the entire length of the body of the key.

8. The ink supply coupling assembly of claim 1, wherein the coupler of the ink container comprises a pressure regulating mechanism including an outer portion on which the conductive component is mounted, wherein the pressure regulating mechanism is configured to at least partially contract when the ink container is empty of ink, which maintains the conductive component in contact against the first end of the first conductive element, and the pressure regulating mechanism is configured to at least partially expand when ink is present in the ink container, which causes movement of the conductive component out of contact relative to the first end of the first conductive element.

9. The ink supply coupling assembly of claim 1, wherein the coupler includes a frame containing a regulator valve mechanism, wherein pressing engagement of the key against the frame causes engagement of the regulator valve mechanism with ink container to cause flow of pressurized ink from the ink container into the regulator valve mechanism.

* * * * *